United States Patent [19]

Ghirardi et al.

[11] 3,995,929

[45] Dec. 7, 1976

[54] FEMALE TERMINAL

[75] Inventors: Paul S. Ghirardi, Masury; Herbert R. Lilley, Cortland; Robert G. Plyler, Vienna, all of Ohio

[73] Assignee: General Motors Corporation, Detroit, Mich.

[22] Filed: Nov. 5, 1974

[21] Appl. No.: 520,923

[52] U.S. Cl. ..... 339/32 R; 339/223 S

[51] Int. Cl.[2] ..... H01R 27/00; H01R 15/12

[58] Field of Search ..... 339/26, 32 R, 33, 223 R, 339/223 S, 256 C, 258 C

[56] References Cited

UNITED STATES PATENTS

| | | | |
|---|---|---|---|
| 1,210,110 | 12/1916 | Smith | 339/223 R X |
| 1,509,224 | 9/1924 | Berthold | 339/223 S |
| 1,568,655 | 1/1926 | Champion | 339/32 R |
| 1,672,201 | 6/1928 | Champion | 339/223 S X |
| 1,988,859 | 1/1935 | Shumaker | 339/252 R X |
| 2,024,814 | 12/1935 | Bell | 339/32 R X |
| 3,771,113 | 11/1973 | Cronce | 339/256 C |
| 3,871,738 | 3/1975 | Dechelette | 339/256 C |

FOREIGN PATENTS OR APPLICATIONS

| | | | |
|---|---|---|---|
| 2,002,733 | 10/1969 | France | 339/223 S |
| 652,163 | 10/1937 | Germany | 339/223 R |

*Primary Examiner*—Joseph H. McGlynn
*Assistant Examiner*—Craig R. Feinberg
*Attorney, Agent, or Firm*—F. J. Fodale

[57] ABSTRACT

A unitary sheet metal female terminal has a pair of longitudinal fingers and a transverse tongue for detachable connection with an enlarged head of a stud terminal in either longitudinal or transverse relationships.

8 Claims, 9 Drawing Figures

FEMALE TERMINAL

This invention relates to electrical female terminals of the type that are detachably connected to the ball-like head of a stud terminal and more specifically to such female terminals which are adapted to be connected to the stud terminal in a generally longitudinal as well as a generally transverse relationship.

Female electrical terminals of the above general type are already known from the U.S. Pat. No. 2,024,814 issued Dec. 17, 1935 to Robert A. Bell for an "Electrical Connector." The female terminal disclosed in the Bell patent, however, has several disadvantages. Firstly, the Bell female terminal while being of a sheet metal construction is unnecessarily complicated and expensive in that it comprises two separate mechanically connected pieces. Further, the piece which is connected to the stud terminal employs three longitudinal resilient fingers for engaging the stud head. Two of the fingers are cut away to receive the stud head transversely of the fingers while the third finger forms a transverse stop. The transverse stop seats the transversely received stud head in recesses in the first two fingers which recesses locate the stud head longitudinally in the female terminal.

Stud terminals received longitudinally between the fingers are seated in the aligned recesses of all three fingers by the self-biasing forces of the three fingers. However, the end portion of all three fingers are cylindrical so as to provide a longitudinal stop engageable with a shoulder below the stud terminal to prevent over insertion of the longitudinally received stud terminal.

The transverse and longitudinal stops provided in the Bell female connector employing three longitudinal fingers are inadequate in one or more respects. For instance, in the case of a transversely received stud terminal, the third finger which provides the transverse stop for properly seating the stud terminal in the recesses of the other two fingers unnecessarily hampers the use of the female terminal in automotive ignition systems which conventionally include an elbow-shaped tubular boot encasing the female terminal which is to be connected to the spark plug stud terminal in a transverse relationship. Specifically the Bell female connector has and can have only one transverse entrance and thus precludes a desirable design feature of having a terminal operative when it is inserted into the elbow-shaped tubular boot upside-down.

But more importantly, the longitudinal stop for preventing over insertion of a longitudinally received stud head is an inadequate arrangement because the cylindrical ends of the three fingers have a tendency to be cammed out of the way of the stop shoulder below the stud terminal when the female terminal is pushed hard down onto the stud terminal. Moreover, the cylindrical ends of the Bell fingers providing the stop preclude a bell-mouthed longitudinal entrance to facilitate blind connections which are often required in automotive ignition systems where the female terminal is encased in a boot and the spark plug terminal is in a cramped engine compartment.

Further with regards to automotive ignition systems, it is desirable to have the female terminal capable of slight universal adjustment to accommodate longitudinal or transverse misalignment necessitated by other components in the cramped engine compartment. Such adjustments are not provided in the Bell female connector which tightly engages the neck of the stud terminal in the longitudinal as well as the transverse relationship.

Accordingly it is an object of this invention to provide an improved terminal of the type adapted for connection to a stud terminal in longitudinal as well as transverse relationships which avoids one or more of the disadvantages of the Bell female connector.

Another object of this invention is to provide a female terminal adapted for connection to a ball-like head of a stud terminal in either a longitudinal or a transverse relationship which is of unitary sheet metal construction.

Another object of this invention is to provide a unitary sheet metal female terminal adapted for connection to a stud terminal having a ball-like head in either a longitudinal relationship, a transverse relationship, or an upside-down transverse relationship.

Still another object of this invention is to provide a unitary sheet metal female terminal adapted for connection to a ball-like head of a stud terminal in either a longitudinal or transverse relationship which may have one or more bell-mouthed entrances for guiding the ball-like head of the stud terminal toward a retained position between resilient fingers of the female terminal.

Still another object of this invention is to provide a unitary sheet metal female terminal having a pair of resilient longitudinal fingers for connecting the female terminal to a ball-like head of a stud terminal in either a longitudinal or transverse relationship in which the resilient fingers have diverging free end portions providing a bell-mouthed longitudinal entrance for guiding a ball-like head longitudinally inserted between the resilient fingers and a transverse stop for properly seating the longitudinally inserted ball-like head between the resilient fingers which is isolated from the camming action imparted to the longitudinal fingers during insertion.

Yet still another object of this invention is to provide a unitary sheet metal terminal having a pair of resilient longitudinal fingers for retaining a ball-like head of a stud terminal in either generally longitudinal or transverse relationships in which the ball-like head is retained between the fingers and seated thereagainst by a resilient transverse finger which permits a slight universal adjustment of the terminal on the stud terminal.

Other objects and features of the invention will become apparent to those skilled in the art as the disclosure is made in the following detailed description of a preferred embodiment of this invention as illustrated in the accompanying sheets of drawing in which.

Figure 1:
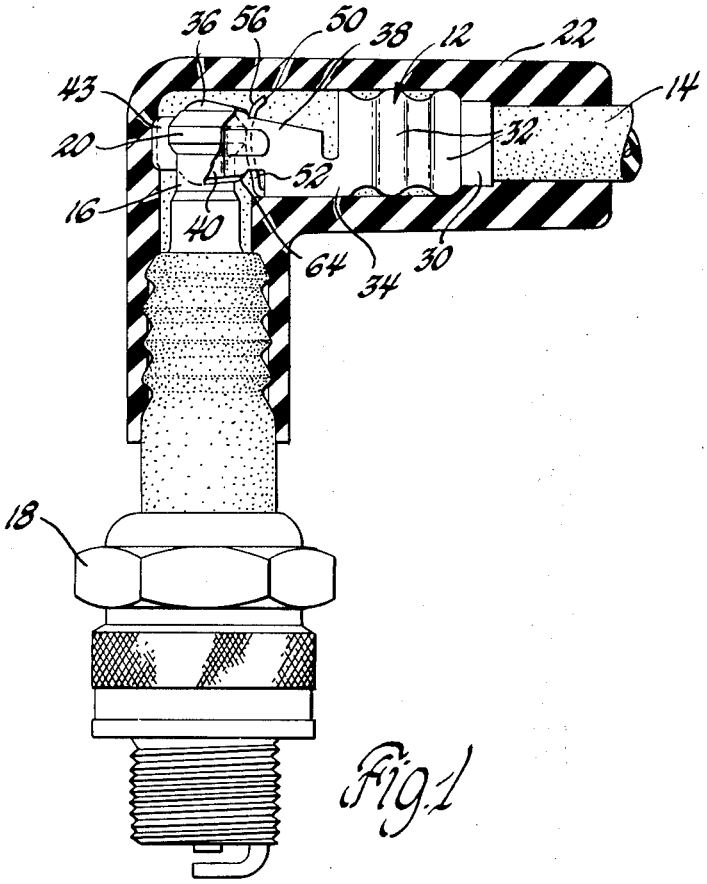
FIG. 1 is an elevational view of a partially sectioned female terminal in accordance with this invention shown attached to a spark plug stud terminal in one transverse relationship.

Referring now to the drawing, there is shown a female terminal 12 attached to the end of an insulated ignition lead wire 14 and operatively connected to the stud terminal 16 of a conventional spark plug 18. The female terminal is detachably connected to an enlarged head 20 of the spark plug in a generally transverse relationship. When the female terminal 12 is connected in this manner it is conventional to provide an elbow-shaped boot 22 which houses the female terminal 12 to seal the connected female terminal 12 and spark plug stud terminal 16 against dirt and other contaminants in the engine compartment. Thus the horizontal end portion of the boot 22 snugly engages the insulated lead wire 14 while the vertical end portion of the elbow is snugly mounted on a ridged portion of the insulator body of the spark plug 18.

Figure 2:
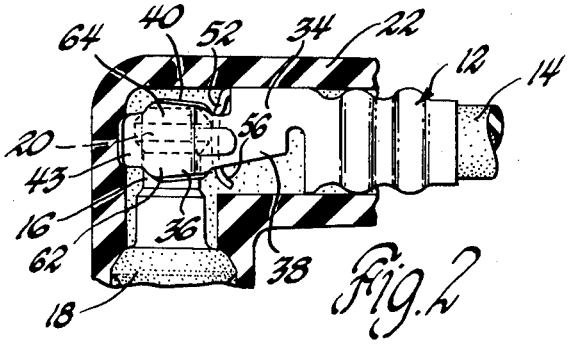
FIG. 2 is a fragmentary, partially sectioned view corresponding to FIG. 1 showing the female terminal operatively connected to the stud terminal of a spark plug in another transverse relationship.

The female terminal 12 may also be disposed in the horizontal leg of the boot 22 in an upside-down position for one reason or another and consequently the female terminal 12 is designed for operative connection to the spark plug stud terminal 16 in this transverse relationship as shown in FIG. 2.

Figure 3:
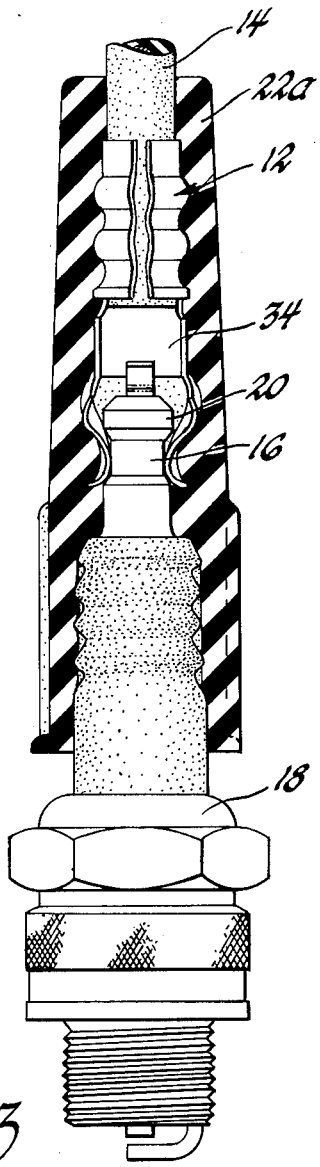
FIG. 3 is an elevation view partially sectioned showing the female terminal shown in FIG. 1 operatively connected to a spark plug terminal in a longitudinal relationship.

In FIG. 3, the female terminal 12 is detachably connected to the enlarged head 20 of the spark plug stud terminal 16 in a longitudinal relationship in which the axes of the female terminal 12 and the stud terminal 16 are substantially aligned. In this configuration, the boot 22*a* housing the terminal is substantially cylindrical.

Figure 4:
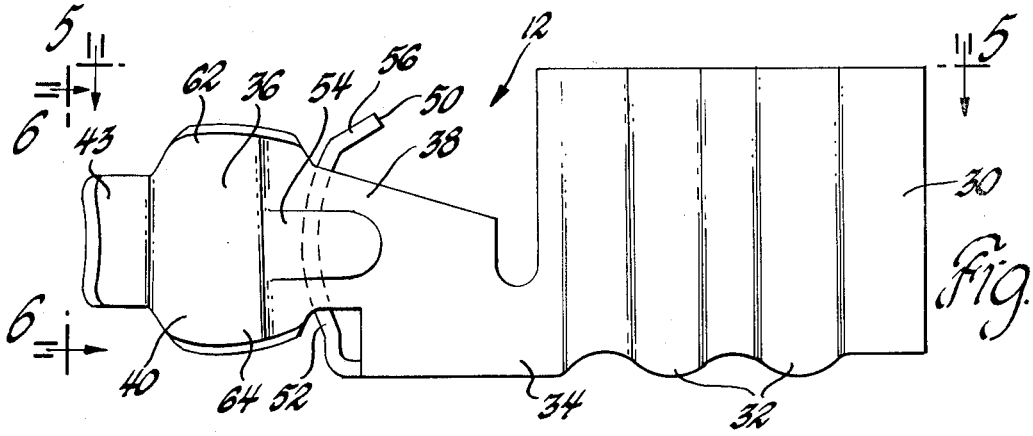
FIG. 4 is an elevation view of the female terminal shown in FIGS. 1, 2 and 3 prior to being crimped onto the end of an insulated lead wire.

Referring now to FIG. 4, the female terminal 12 is seen to consist of a unitary sheet metal stamping comprising a U-shaped ferrule portion 30 having transverse corrugations 32 which securely fasten the female terminal 12 to the end of insulated lead wire 14, shown in FIGS. 1 and 3, when the ferrule portion is crimped about the end of the insulated lead wire in a conventional manner. Integrally connected to the forward end of the ferrule portion 30 is a bridge portion 34 to which a pair of transversely spaced longitudinally resilient fingers 36 are integrally connected. The fingers 36 are substantially identical and disposed in a mirror-like relationship. Each comprises a rearward portion 38 contiguous with the bridge portion 34 and a forward portion 40 extending away from the bridge portion 34 and ferrule portion 30.

Figure 5:
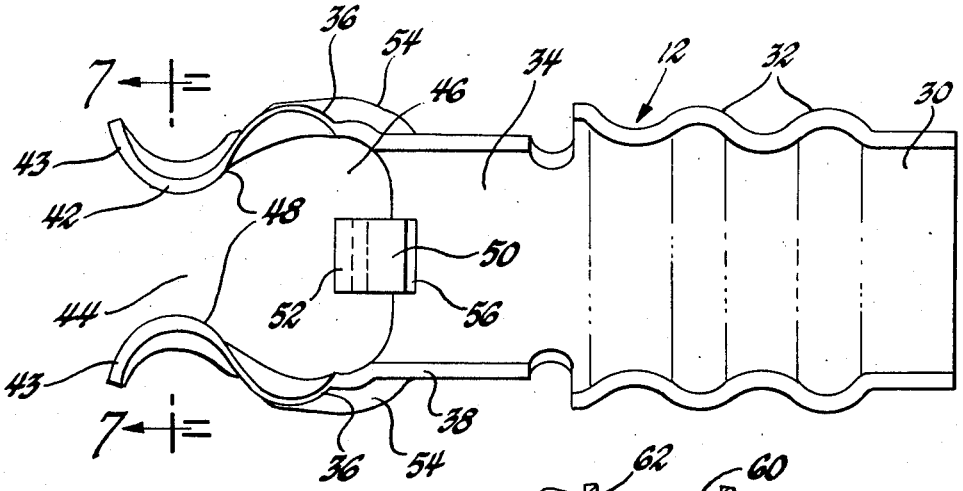
FIG. 5 is a top view substantially along the line 5—5 of FIG. 4.
Figure 7:
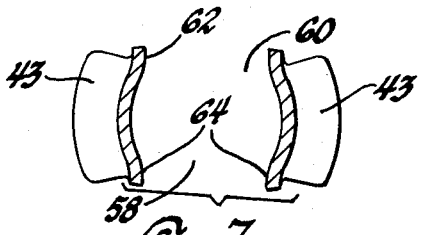
FIG. 7 is a view taken substantially along the line 7—7 of FIG. 5.
Figure 6:
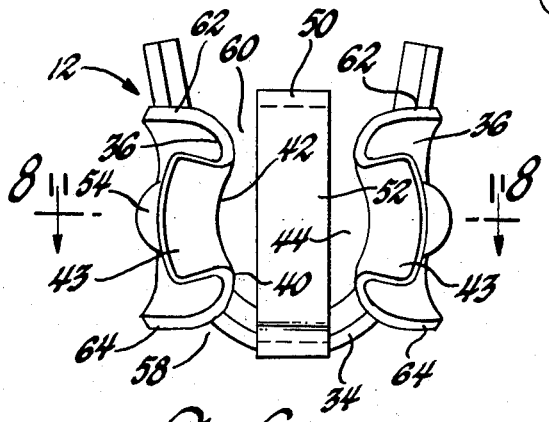
FIG. 6 is a front view of the female terminal shown in FIG. 4 substantially along the line 6—6 of FIG. 4.
Figure 8:
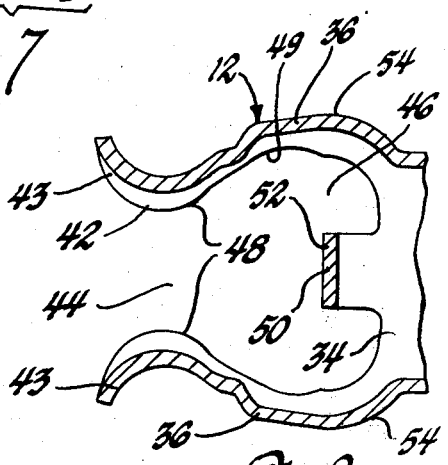
FIG. 8 is a view taken substantially along the line 8—8 of FIG. 6.
Figure 9:
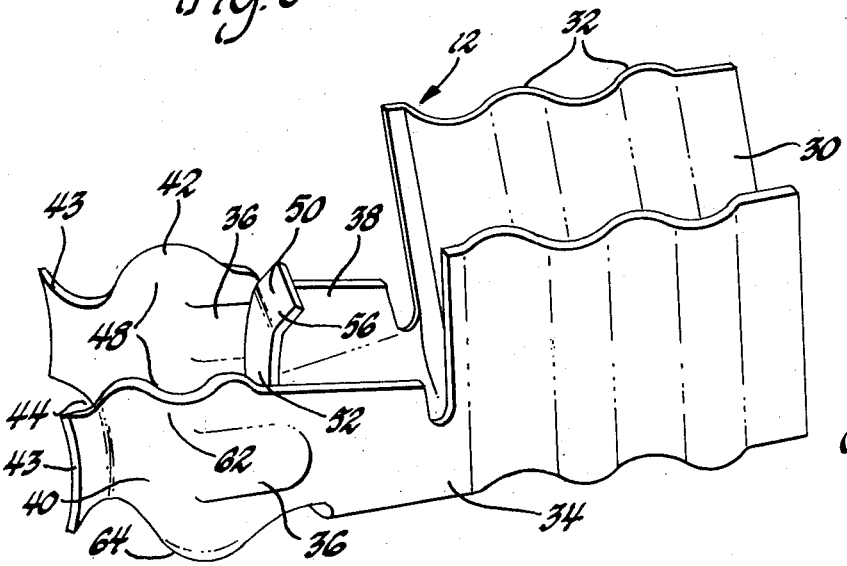
FIG. 9 is a perspective view of the female terminal shown in FIGS. 1–7.

As best illustrated in FIGS. 5 and 6, the forward portion 40 has an inwardly bent transverse bight portion 42 which forms a throat 44 of reduced transverse dimension with respect to the terminal receiving space 46 between the fingers 36 rearwardly of the throat. While the bight portions 42 are convex in the inward direction in longitudinal section as shown in FIGS. 5 and 8, the bight portions 42 are concave in the inward direction in transverse cross-section as shown in FIGS. 6 and 7. Preferably this concave lateral cross-section extends not only rearwardly from the throat 44 but also forwardly for some distance on the diverging free ends 43 of the fingers 36 to provide a rounded bell-mouth entrance to the throat 44 for longitudinally receiving a stud terminal and guiding it for disposition in the space 46 by being snapped past the throat 44 defined by the resilient fingers 36.

Because of the compound curvature of the forwardly coverging portions 48 which are rearwardly of the throat 44, a seat 49 is provided on the inner surface which laterally locates the enlarged head of the spark plug terminal shown in FIGS. 1, 2 and 3 when it is held against the seat 49. For this purpose, the female terminal 12 includes a resilient transverse tongue 50 which is connected at one end to the bridge portion 34. The resilient transverse tongue 50 is best illustrated in FIG. 4 where it is seen that the tongue 50 is integrally connected to the forward end of the bridge and extends upwardly therefrom. The tongue 50 has a curved mid portion 52 which is adapted to engage the enlarged head 20 of the stud terminal 16 on the opposite side from where it is enlarged by the converging portions 48 of the fingers 36 irrespective of whether the female terminal 12 and stud terminal 16 are connected longitudinally or transversely. In order to facilitate forming the compound curvature on the forwardly converging portions 48 of the fingers, the rearward portions 38 of the fingers 36 are stiffened with longitudinal ribs 54 to provide a stable base from the forward portions 40 of the fingers. Preferably the longitudinal ribs 54 merge at their forward ends with the transverse bight portions 42 of the forward finger portions 40. The resilient tongue 50 performs substantially the same function irrespective of how the terminal is connected to the stud terminal, namely, it biases the enlarged head 20 of the stud terminal 16 into engagement with the seat provided by the forwardly converging portions 48 of the resilient fingers 36.

It should be noted that the resilience of the transverse tongue 50 allows a slight universal adjustment of the female terminal 12 with respect to the stud terminal 16 whether the terminals are connected in a generally longitudinal relationship, a generally transverse relationship or an upside-down generally transverse relationship.

The free end portion 56 of resilient tongue 50 is bent back toward the ferrule portion 30 to avoid interference with a stud terminal shoulder below the enlarged head 20 when the female terminal 12 is connected thereto upside-down as shown in FIG. 2.

It should also be noted that the finger design-transverse tongue design of this invention permits the female terminal 12 to be connected to the stud terminal 16 in the two transverse relationships shown in FIGS. 1 and 2 respectively. In this regard, the first transverse throat 58 for transversely receiving the enlarged head 20 of the stud terminal 16 for connecting the terminals as shown in FIG. 1 is provided by the forwardly converging portions 48 in combination with the resilient tongue 50 as the rearward portions 38 have no surfaces or edges which would interfere with the insertion of the enlarged head 20 into the space 46. Similarly the second transverse throat 60 for transversely receiving the enlarged head 20 of the stud terminal 16 for connecting the terminals as shown in FIG. 2 is also provided by the forwardly converging portions 48 of the fingers 36 in combination with the resilient tongue 50 and that likewise the rearward portions 38 do not have any surfaces or edges which interfere with insertion of the enlarged head 20 into the space 46.

As previously mentioned, the resilient fingers have diverging free ends 43 providing a rounded bell-mouthed entrance for longitudinally receiving the enlarged head 20. It is also preferable to provide rounded bell-mouthed entrances leading to each of the transverse throats 58 and 60.

To this end the fingers 36 are provided with upper and lower longitudinally disposed flared skirt portions 62 and 64 respectively which are contiguous with the bight portions 42 at least from the throat 44 rearwardly. The curved mid portion 52 of the tongue 50 also preferably extends slightly above and below the upper and lower throats 58 and 60 respectively to contribute toward the guidance of the enlarged head 20 toward the throats 58 and 60 when such is transversely received.

We wish it to be understood that we do not desire to be limited to the exact details of construction shown and described, for obvious modifications will occur to a person skilled in the art.

What is claimed is:

1. A unitary sheet metal female electrical terminal adapted for detachable connection with an enlarged ball-like head of a stud terminal in a longitudinal as well as a transverse relationship comprising:

a ferrule portion adapted to be crimped about an end of a lead wire, a bridge portion integrally connected to a forward end of said ferrule portion, a pair of transversely spaced longitudinally resilient fingers having rearward portions integrally connected to said bridge portion and forward portions extending away from said ferrule portion, a transverse resilient tongue integrally connected at the forward end of said bridge portion, said transverse resilient tongue being substantially upright with respect to a longitudinal axis of the terminal and having a forwardly bowed mid portion disposed between said pair of transversely spaced longitudinally resilient fingers, and said forward portions having inwardly depressed transversed bight portions spaced longitudinally from said transverse resilient tongue and providing forwardly converging portions and a longitudinal throat, said forwardly converging portions having concavo-convex transverse cross sections which are concave in the inward direction for engaging and retaining an enlarged ball-like head of a stud terminal engaged on an opposite side by said resilient tongue and for providing a transverse throat in cooperation with said resilient tongue.

2. The unitary sheet metal female electrical terminal defined in claim 1 wherein said forward portions have diverging free end portions which are contiguous with said bight portions and concave in the inward direction to provide a rounded bell-mouthed entrance for guiding a longitudinally received ball-like head of a stud terminal toward the longitudinal throat provided by said bight portions to facilitate connection of said terminals.

3. The unitary sheet metal female electrical terminal defined in claim 1 wherein said terminal has a transverse bell-mouthed entrance provided at least in part by longitudinally disposed flared skirt portions on said fingers and which are at least partially contiguous with said forwardly converging portions and extend rearwardly from said longitudinal throat for guiding a transversely received ball-like head of a transversely disposed stud terminal toward the transverse throat provided by the concavo-convex cross sections of said forwardly converging portions in cooperation with said resilient tongue.

4. The unitary sheet metal female terminal as defined in claim 1 wherein said rearward portions have outwardly bent longitudinal ribs having forward ends merging with the inwardly bent transverse bight portions of said forward portions and wherein said resilient tongue is aligned with said rearward portions and disposed midway therebetween.

5. The unitary sheet metal female electrical terminal as defined in claim 1 wherein said terminal has only a single pair of longitudinal fingers connected to said bridge and extending away from said ferrule portion and wherein the forwardly converging portions of said pair of longitudinal fingers each have upper and lower portions respectively defining first and second transverse throats in cooperation with said transverse tongue which respectively provide for transversely receiving an enlarged head of a stud terminal from opposite transverse directions.

6. The unitary sheet metal female electrical terminal defined in claim 5 wherein said forward portions have diverging free end portions which are contiguous with said bight portions and concave in the inward direction to provide a rounded bell-mouthed entrance for guiding a longitudinally received ball-like head of a stud terminal toward the longitudinal throat provided by said bight portions to facilitate connection of said terminals.

7. The unitary sheet metal female electrical terminal defined in claim 6 wherein said fingers have upper and lower longitudinally disposed flared skirt portions which are at least partially contiguous with said forwardly converging portions and extend rearwardly from said longitudinal throat to provide upper and lower bell-mouthed transverse entrances for guiding a transversely received ball-like head of a stud terminal a respective one of said transverse throats provided by the concave-convex cross sections of said forwardly converging portions in cooperation with said resilient tongue.

8. The unitary sheet metal connector as defined in claim 7 wherein said resilient tongue integrally connected at the forward end of said bridge portion is aligned with said rearward portions and disposed midway therebetween and has a free end portion extending outwardly of the fingers which is bent toward said ferrule portion.

* * * * *

UNITED STATES PATENT AND TRADEMARK OFFICE

CERTIFICATE OF CORRECTION

PATENT NO. : 3,995,929

DATED : December 7, 1976

INVENTOR(S) : Paul S. Ghirardi et al

It is certified that error appears in the above-identified patent and that said Letters Patent are hereby corrected as shown below:

Column 6, line 45, after "terminal" insert -- toward --.

Signed and Sealed this

Twenty-second Day of March 1977

[SEAL]

*Attest:*

RUTH C. MASON
*Attesting Officer*

C. MARSHALL DANN
*Commissioner of Patents and Trademarks*